United States Patent [19]

Niki et al.

[11] Patent Number: 4,845,002

[45] Date of Patent: Jul. 4, 1989

[54] TONER FOR DEVELOPMENT OF ELECTROSTATICALLY CHARGED IMAGE

[75] Inventors: Masao Niki, Wakayama; Shinichiro Yasuda, Misakimachi; Yukinaga Yokota, Osaka; Kazuhiko Okabe, Wakayama, all of Japan

[73] Assignee: Kao Corporation, Tokyo, Japan

[21] Appl. No.: 127,179

[22] Filed: Dec. 1, 1987

[30] Foreign Application Priority Data

Dec. 1, 1986 [JP] Japan ..... 61-286443
Dec. 1, 1986 [JP] Japan ..... 61-286444
Dec. 1, 1986 [JP] Japan ..... 61-286445

[51] Int. Cl.[4] ..... G03G 9/12
[52] U.S. Cl. ..... 430/109; 430/110
[58] Field of Search ..... 430/110, 115, 109

[56] References Cited

U.S. PATENT DOCUMENTS 4,656,111 4/1987 Wakamiya et al. ..... 430/110
4,719,165 1/1988 Kitatani et al. ..... 430/110

*Primary Examiner*—John L. Goodrow
*Attorney, Agent, or Firm*—Birch, Stewart, Kolasch & Birch

[57] ABSTRACT

A toner for development of an electrostatically charged image which comprises at least a binder, a colorant and a compound having the formula (I) or (III):

(I)

(III)

wherein

A represents a phenol group-containing compound residue,

B represents a group of the general formula (II):

(II)

wherein $R_1$ and $R_4$ each represent a methylene or ethylene group, $R_2$ and $R_3$ each represent an alkyl, aryl, alkenyl, aralkyl or cyclic alkyl group or $R_2$ and $R_3$ may be combined to form a ring, $R_5$ represents an alkylene group having 1 to 8 carbon atoms or an arylene group, preferably phenylene, $R_6$ and $R_7$ each represent a hydrogen atom or an alkyl, aryl, aminoalkyl, aralkyl or cyclic alkyl group having 1 to 8 carbon atoms or $R_6$ and $R_7$ may be combined to form a ring, p represents a number of 1 to 200, $n_1$ and q each is zero or 1, r is zero or an integer of 1 to 3 and $n_2$ is an integer of 1 to 3 or zero in the formula (I) and a number of 1 to 400 in the formula (III).

3 Claims, No Drawings

TONER FOR DEVELOPMENT OF ELECTROSTATICALLY CHARGED IMAGE

PRIOR ART

An ordinary electrophotographic process comprises uniformly electrostatically charging a photoconductive insulating layer, exposing the layer to light, dissipating the electric charge from the exposed portion to form an electrostatic latent image, applying a colored, charged fine powder called a toner to the electrostatic latent image to visualize the image (development step), transferring the obtained visible image onto a transfer material such as a transfer paper (transfer step) and permanently fixing it by heating, by applying pressure or by another suitable fixing method (fixing step) as described in the specifications of U.S. Pat. Nos. 2,221,776, 2,297,691 and 2,357,809.

Developing methods employed in these electrophotographic processes are roughly classified into a dry development method and a wet development method. The former can be further classified into a method wherein a developing agent comprising two components is used and a method wherein a developing agent comprising one component is used. The former developing method wherein a two-component developing agent is used is further classified into various methods different from one another in the toner-carrying system such as a magnetic brush method wherein a magnetic powdery carrier is used by taking advantage of its magnetic force, a cascade method wherein a relatively coarse bead carrier is used and a fur brushing method wherein glass fibers are used in place of the carrier particles or beads.

As the tone used in these developing methods, a fine powder prepared by dispersing a colorant such as a dye or pigment in a natural or synthetic thermoplastic resin has been used. For example, fine particles having a size of about 1 to 30μ prepared by dispersing a colorant and additives which will be described below in a binder resin such as polystyrene or polyester and finely dividing the dispersion are used. As magnetic toners used mainly with the one-component developing agent, those containing particles of a magnetic substance such as magnetite are used. On the other hand, in the development with the two-component developing agent, the toner is usually used in the form of a mixture with glass beads or carrier particles such as iron powder. It is required of the toner that it has a positive or negative charge uniformly depending on the polarity of the electrostatic latent image to be developed.

Though a desired electric charge of the toner can be maintained by frictional electrification of the carrier, a material constituting the surface of the carrier or a resin which is a constituent of the toner, the background is easily fogged and comes to have a noise. As a result, an image formed with such development remains unclear. Because the electrostatic charge of the toner is low or the desired quantity of the charge is not attained rapidly by this process alone. Therefore, a dye or pigment capable of rapidly imparting a desired frictional electrification property or an electric charge-controlling agent is used in order to rapidly impart a desired quantity of the frictional electricity.

For providing the positive charge, an electrondonating dye such as a Nigrosine dye is effective. For a negative toner, an electron-accepting organic complex such as an oil-soluble metal-containing dye is used widely.

The Nigrosine dye is frequently modified with oleic acid or stearic acid, since its dispersibility in the resin is low.

Those used for the positive toners include, for example, Iozol Black, aliphatic amines, quaternary ammonium salts, compounds comprising a quaternary ammonium salt and a long chain-having alkyl group, Fett Schwarz HBW, Sudan Teak Schwarz BBC, Brilliant Spirit, Zapon Schwarz X and Solvent Red. Those used for the negative toners include, for example, colloidal silica, metal salts of aliphatic compounds, metal complex salts of monoazo dyes, chlorinated paraffins, chlorinated polyesters, Spiron Black (a product of Hodogaya Chemical Co., Ltd.), Valifast Black (a product of Orient Chemical Co., Ltd.), Chromogen Schwarz ETCO and Azo Oil Black. Usually those prepared by aminating copper phthalocyanine and introducing a substituent thereinto or chromium-containing dimers having a nitro group are used.

Many of these electric charge regulators are derived from dyestuffs or pigments and they usually have a complicated structure and many of them have a strong tinting power.

Since colored dyestuff cannot be used for the color toners, the utilization of a colorless electric charge regulator is investigated in addition to the above-mentioned utilization of the frictional electrification of the resin. Though quaternary ammonium compounds, dehydration condensates in ortho-position of an amine with a dicarboxylic acid, vinylpyridine and vinylpyrazine are used, the overall capacities of them are inferior to those of the electric charge regulators derived from dyestuffs or pigments. Under these circumstances, the dyestuffs are used in most cases, though they are unsatisfactory.

They are usually added to a thermoplastic resin and the mixture is molten by heating, kneaded, finely pulverized and, if necessary, sized to obtain a powder having a suitable particle diameter.

However, many of these dyestuffs used as the electric charge regulator have a complicated structure, and their properties are variable and unstable. Further, they are easily decomposed in the step of kneading under heating and they are easily decomposed or modified by a mechanical shock, friction or a change in temperature or humidity. Thus their electric charge regulating properties are reduced.

Therefore, when a tone containing such a dyestuff as the electric charge regulator is used for the development in a copying machine, this regulator is decomposed or modified as the number of copies is increased to deteriorate the toner in the duration of life.

These electric charge regulators have a fatal defect that the quantity of the electricity charged by the frictional electrification of the toner particles is not uniform, since it is quite difficult to homogeneously disperse the electric charge regulator in the thermoplastic resin. Various processes have, therefore, been proposed for obtaining a homogeneous dispersion. For example, a basic Nigrosine dyestuff is used in the form of its salt with a higher fatty acid so as to improve its compatibility with a thermoplastic resin. However, an unreacted fatty acid or dispersion product of the salt frequently appears on the toner surface to stain the carrier or carried toner and to cause reduction in the fluidity of the toner, fog or reduction in the image density. Another process for improving the dispersibility of the electric charge regulator in the resin has also been employed. This process comprises mechanically pulverizing a powdery electric charge regulator with a powdery resin before kneading the mixture under melting by heating. However, the essential problem of the poor dispersibility cannot be solved and no practically sufficient homogeneity of the electric charge can be obtained. Thus, no developing agent having a long life has been developed heretofore.

Most of known electric charge regulators are chromatically colored or dark and, therefore, they cannot be incorporated in a developing agent of a desired vivid chromatic color unfavorably.

Further, many of the electric charge regulators are hydrophilic and not highly dispersible in the resins and, therefore, they appear on the toner surface after the melt kneading and pulverization. Thus, when the toner is used under a high-humidity condition, any image having a high quality cannot be obtained, since the electric charge regulator used is hydrophilic.

As described above, when the conventional electric charge regulator is incorporated in the toner, the quantities of the electric charge of the toner particles are various or the quantity of the electric charge generated on the toner particle surfaces in the frictional electrification step between the toner and the carrier is not uniform. As a result, troubles such as fog in the development, scattering of the toner and staining of the carrier take place. These troubles become serious as the number of copies is increased. Thus, the conventional electric charge regulators are substantially unsuitable for copying machines.

Under a high-humidity condition, the toner image transfer efficiency is reduced seriously and impractically. After storage of the toner even under ambient temperature and humidity conditions, it is modified due to unstability of the electric charge regulator used and it becomes useless due to an insufficient electric charge.

Further when the conventional electric charge regulator is incorporated in the toner, the regulator adheres to the surface of a photosensitive body or the adhesion of the toner is accelerated to exert a bad influence on the latent image formation (filming phenomenon) or to form a scar on the surface of a photosensitive body or a cleaning member such as a cleaning blade or to accelerate the abrasion of the member during the use over a long period of time. Thus bad effects are exhibited in the cleaning step of the copying machine.

Many of the ordinary electric charge regulators exert a great influence on the melting behavior of the toner to deteriorate the fixability thereof when they are incorporated in the toner. Other defects of them are that they deteriorate a high-temperature offset printability that they damage the quality of the copy image, that they accelerate the wrap of the transfer paper around the roller and that the toner adheres to the roller to reduce the durability or life of the roller.

Thus the ordinary electric charge regulators have many defects and it has been demanded to overcome these defects in the art. Though various techniques have been proposed to overcome the defects, no technique which is satisfactory from the practical and overall viewpoints has been developed.

SUMMARY OF THE INVENTION

An object of the present invention is to provide a new technique of regulating the electric charge of the toner by solving the above-mentioned problems.

Another object of the present invention is to provide a developing agent in which a constant quantity of electric charge is provided in the step of the frictional electrification among toner particles or between a toner and a carrier, the rise of the frictional electrification is rapid and the quantity of electric charge can be controlled suitably for the development system employed.

Still another object of the present invention is to provide a developing agent capable of forming and transferring an image with a high fidelity to the latent image without causing any adhesion of the toner in the background region, i.e. scattering of the toner around an edge of the latent image, or fog, to provide a high image density and a high halftone reproducibility.

A further object of the present invention is to provide a developing agent having a high toner consumption efficiency which maintains its initial characters during the continuous use over a long period of time without causing coagulation of the toner or change in the electric charge.

Another object of the present invention is to provide a developing agent capable of reproducing a stable image without being influenced by a change in temperature or humidity, particularly a developing agent with which neither scattering nor local failure in transfer in the transfer step is caused in the transfer step under a high- or low-humidity condition.

Another object of the present invention is to provide a developing agent having an excellent fixing character, particularly, a developing agent having no problem in the high-temperature offset printing.

Another object of the present invention is to provide a vivid chromatic developing agent.

Another object of the present invention is to provide a developing agent having an excellent storage stability which maintains the initial character thereof even after the storage for a long period of time.

Another object of the present invention is to provide a developing agent which does not stain, abrade or scar the surface of the electrostatic latent image in the cleaning step, so that the cleaning is conducted easily.

The present invention relates to an electrophotographic toner used for the development of an electrostatically charged image, characterized by comprising at least a binder resin, a colorant and a compound of the following formula (I) or (III):

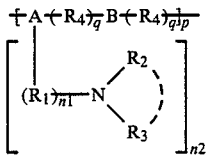

(I)

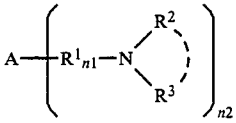

(III)

wherein

A represents a phenol group-containing compound residue,

B represents a group of the following general formula (II):

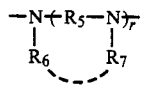

(II)

$R_1$ and $R_4$ each represent a methylene or ethylene group, $R_2$ and $R_3$ each represent an alkyl, aryl, alkenyl, aralkyl or cyclic alkyl group or $R_2$ and $R_3$ may be combined to form a ring, $R_5$ represents an alkylene group having 1 to 8 carbon atoms or an arylene group, preferably phenylene, $R_6$ and $R_7$ each represent a hydrogen atom or an alkyl, aryl, aminoalkyl, aralkyl or cyclic alkyl group having 1 to 8 carbon atoms or $R_6$ and $R_7$ may be combined to form a ring, p represents a number of 1 to 200, $n_1$ and q each is zero or 1, r is zero or an integer of 1 to 3 and $n_2$ is an integer of 1 to 3 or zero in the formula (I) and a number of 1 to 400 in the formula (III).

When n2 is zero in the formula (I), a preferable embodiment of the compound is provided, having the formula (IV):

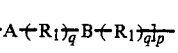

(IV)

The compound as above defined may be either a monomer or a polymer of the monomer. The polymer can be obtained by a conventional polymerization such as the vinyl polymerization. The compound has, at the terminals of the molecule thereof, hydrogen, hydroxyl or a hydrocarbon group such as an alkyl, an amino, a carboxylic group and a carboxylic ester group. The terminals may be derived from a polymerization initiator used in the production.

Examples of the phenol group-containing compound residue A in the above general formula include residues from the following compounds: alkylphenols such as phenol, cresol, ethylphenol, n-propylphenol, isopropylphenol, n-butylphenol, sec-butylphenol, tert-butylphenol, sec-amylphenol, isopentylphenol, hexylphenol and octylphenol; halogenated phenols such as chlorophenol and bromophenol; arylphenols such as p-cyclohexylphenol, phenylphenol and tolylphenol; disubstituted phenols such as 2,3-xylenol, 3,4-xylenol, 2,5-xylenol, 2,3-diethylphenol, 3,4-diethylphenol, 2,5-diethylphenol, 2,3-diisopropylphenol, 3,4-diisopropylphenol, 2,5-diisopropylphenol, 2,3-dichlorophenol and 3,4-dichlorophenol; polyphenols such as bisphenol A, bisphenol F, 1,1,2,2-tetrakis(4-hydroxyphenyl)ethane, 4,4'-[1,4-phenylenebis(1-methylethylidene)]bisphenol and α,α',α''-tris(4-hydroxyphenyl)-1,3,5-triisopropylbenzene; and polyhydric phenols such as catechol, resorcinol, hydroquinone, phloroglucinol and 1,2,4-trihydroxybenzene; as well as novolac-type polyphenols prepared by formalin condensation of the above-mentioned phenols, and phenolic polymers such as p-hydroxystyrene/acrylic ester copolymers.

Typical examples of the compounds of the above general formula (I) include the following ones:

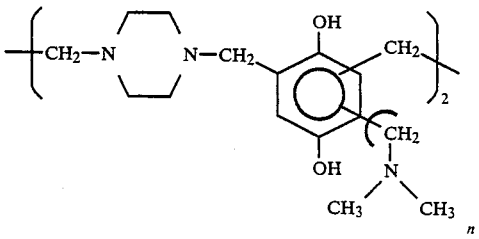

(1)

n = 2
$\bar{p}$ = 12.0

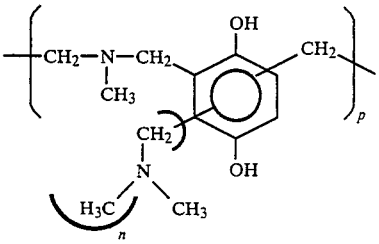

(2)

n = 2
$\bar{p}$ = 12.0

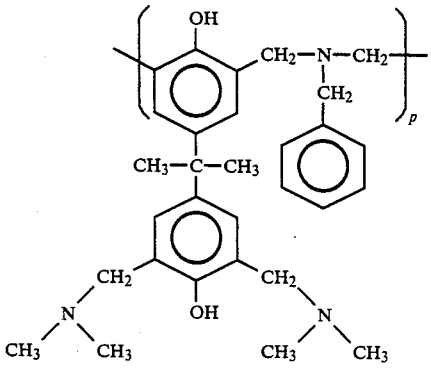

(3)

$\bar{p}$ = 10.0

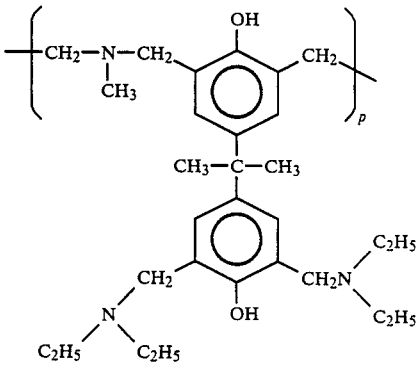

(4)

$\bar{p}$ = 5.0

-continued
(5)
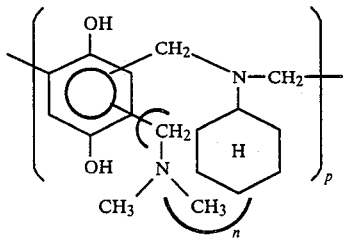
$\bar{p}$ = 10.0
n = 2
(6)
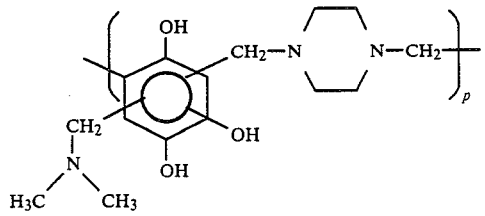
$\bar{p}$ = 5.-
(7)
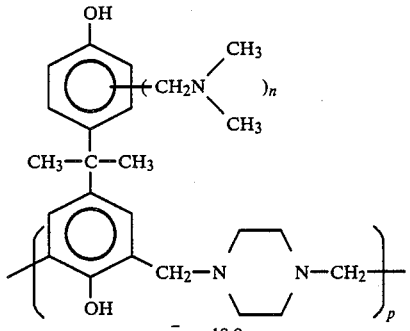
$\bar{p}$ = 10.0
n = 1.5
(8)
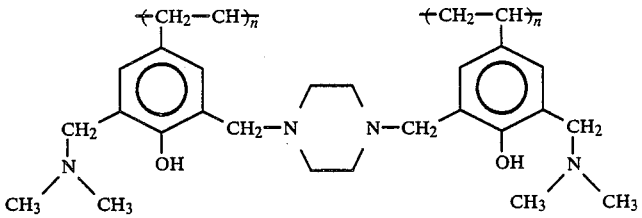
$\bar{n}$ = 15.0
(9)
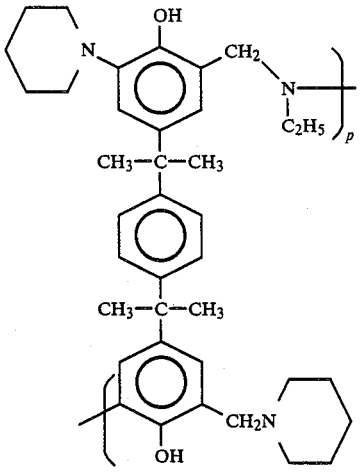
$\bar{p}$ = 5.0
n = 2
(10)
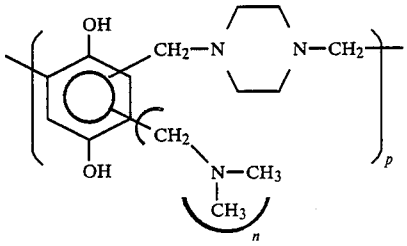
$\bar{p}$ = 5.0
(1)
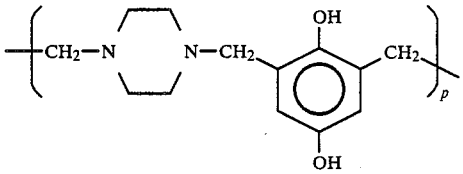
$\bar{p}$ = 12.0
Examples of the compound having the formula (IV) are shown below.

-continued
(2)
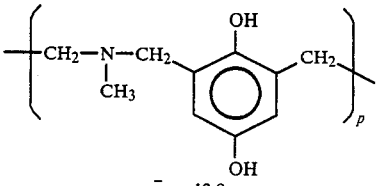
$\bar{p} = 12.0$
(3)
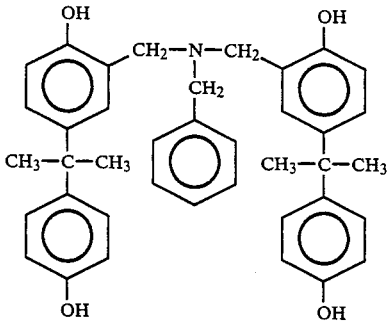
(4)
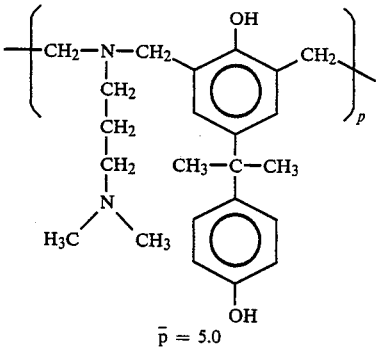
$\bar{p} = 5.0$
(5)
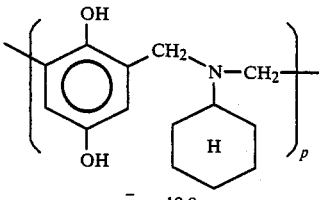
$\bar{p} = 10.0$
-continued
(6)
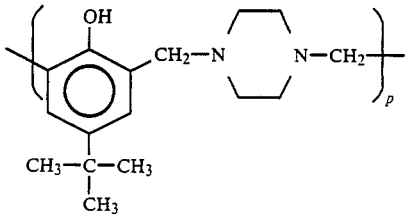
$\bar{p} = 5.0$
(7)
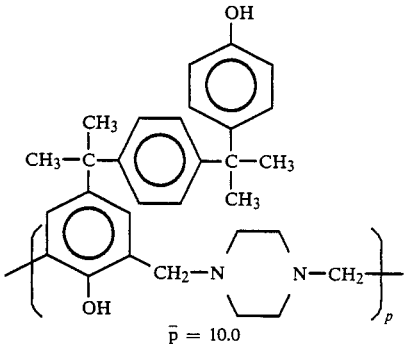
$\bar{p} = 10.0$
(8)
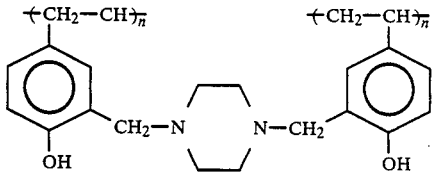
$\bar{n} = 15.0$
(9)
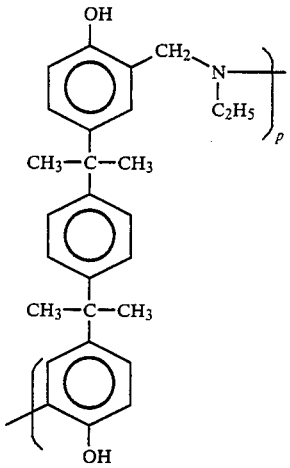
$\bar{p} = 5.0$
Examples of the compound having the formula (III) are shown below.
(1)
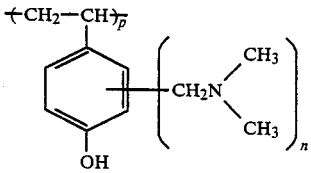
$\left(\begin{array}{l}\bar{n} = 2.0\\ \bar{p} = 15\end{array}\right)$
(2)
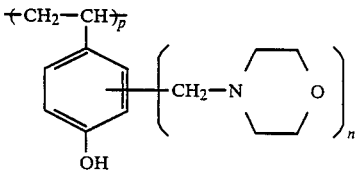
$\left(\begin{array}{l}\bar{n} = 1.8\\ \bar{p} = 35\end{array}\right)$ -continued
(3)
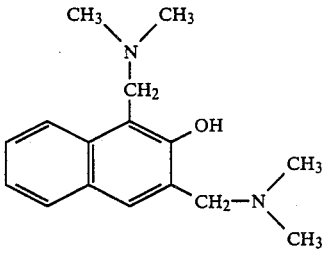
(4)
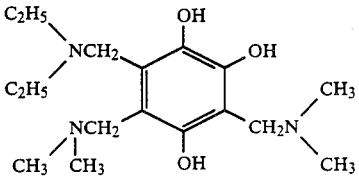
(5)
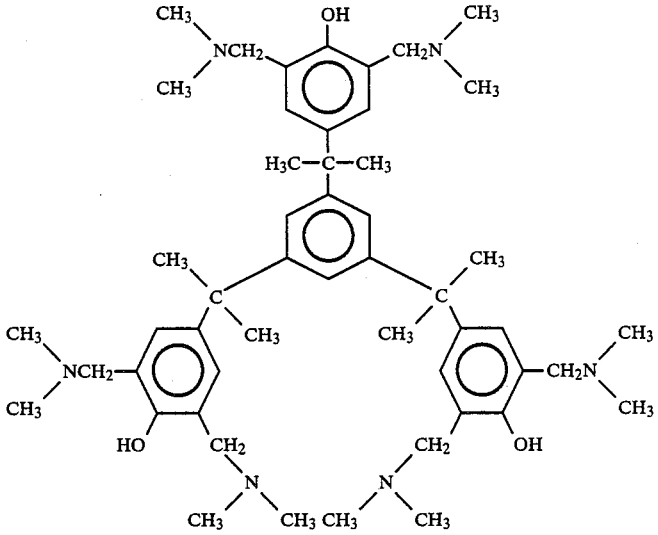
(6)
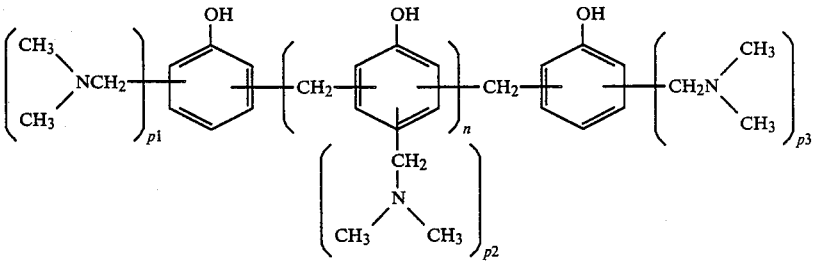
n = 2.0
p1 + p2 + p3 = 3.0
(7)
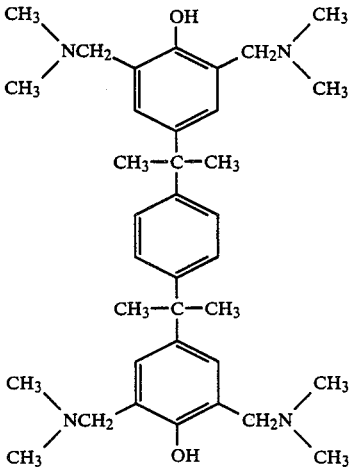

-continued

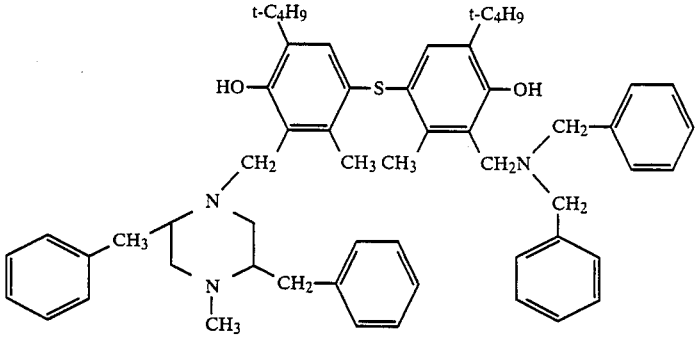

(8)

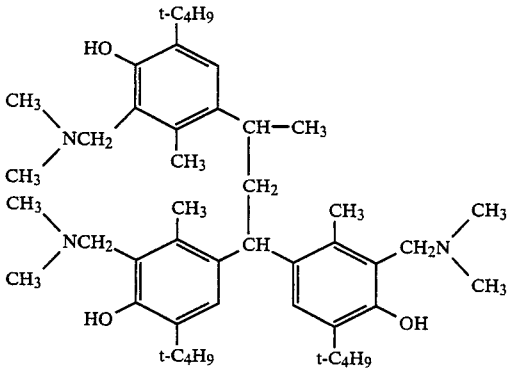

(9)

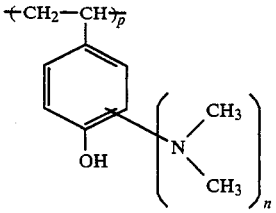

(10)

n = 1.5
p = 50

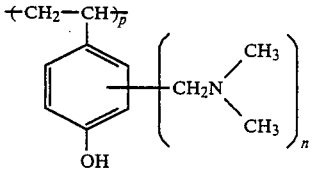

(11)

n = 2.0
p = 160

The compounds of the above general formula (I) used in the present invention are preferably in solid form at ambient temperature and more preferably they have a softening point of 50° C. or higher. Compounds which are in liquid form at ambient temperature or compounds having a low softening point bleed out to the surface of the powdery toner in the course of the storage over a long period of time or during the use to cause an electric modification. Further they cause the filming of the developer and the photosensitive material to change the image.

The compound of the general formula (1) can be added to the toner either internally or externally. In the internal addition, the amount of this compound is not particularly limited, since it varies depending on the kind of the binder resin, additives used if necessary and the process for the preparation of the toner including the dispersion method. Preferably, however, it is used in an amount of 0.1 to 20 parts by weight (more preferably 0.5 to 10 parts by weight) for 100 parts by weight of the binder resin.

In the external addition, the compound has preferably a softening point of 100° C. or higher and a particle diameter of 10 μm or less. The amount of the compound added is desirably 0.01 to 10 parts by weight for 100 parts by weight of the resin.

The electric charge regulator of the present invention can be used in combination with a known electric charge regulator or a combination of two or more electric charge regulators of the present invention can be used.

The colorants used in the present invention include all of known dyestuffs and pigments such as carbon black, lamp black, black iron oxide, ultramarine, Nigrosine dyestuffs, Aniline Blue, Phthalocyanine Blue, Phthalocyanine Green, Hansa Yellow G, Rhodamine 6G, lakes, Chalco Oil Blue, chrome yellow, quinacridone, Benzidine Yellow, Rose Bengal, triarylmethane dyestuffs, monoazo dyestuffs and pigments, and disazo dyestuffs and pigments. They can be used either singly or in the form of a mixture of them.

Examples of the binder resins usable in the present invention include monomers and polymers of styrene and substituted derivatives thereof such as polystyrene, poly-p-chlorostyrene and polyvinyltoluene; styrene copolymers such as styrene/p-chlorostyrene copolymer, styrene/porpylene copolymer, styrene/vinyltoluene copolymer, styrene/vinylnaphthalene copolymer, styrene/methyl acrylate copolymer, styrene/ethyl acrylate copolymer, styrene/butyl acrylate copolymer, styrene/octyl acrylate copolyer, styrene/methyl methacrylate copolymer, styrene/ethyl methacrylate copolymer, styrene/butyl methacrylate copolymer, styrene/acrylonitrile copolymer, styrene/vinyl methyl ether copolymer, styrene/vinyl methyl ketone copolymer, styrene/butadiene copolymer, styrene/iosprene copolymer, styrene/acrylonitrile/indene copolymer, styrene/maleic acid copolymer and styrene/maleic ester copolymer; and polymethyl methacrylate, polybutyl methacrylate, polyvinyl chloride, polyvinyl acetate, polyethylene, polypropylene, polyester, polyurethane, polyamide, epoxy resin, polyvinyl butyral, polyacrylic acid resin, rosin, modified rosin, terpene resin, phenol resin, aliphatic or alicyclic hydrocarbon resin, aromatic petroleum resin, chlorinated paraffin and paraffin wax. They can be used either singly or in the form of a mixture of them.

When the two-component developing agent is used, the toner of the present invention is used in the form of a mixture with a carrier powder.

All of known carriers can be used as the carrier of the present invention. They include, for example, magnetic powders such as iron powder, ferrite powder and nickel powder, glass beads and those the surfaces of which have been treated with a resin or the like, and a powder prepared by melt-kneading a magnetic material which will be described below with a binder resin and pulverizing the mixture.

A magnetic material can be incorporated in the toner of the present invention so that the latter is used as a magnetic toner. The magnetic materials which can be contained in the magnetic toner of the present invention include, for example, iron oxides such as magnetite, hematite and ferrite; metals such as iron, cobalt and nickel; alloys of these metals with other metals such as aluminum, cobalt, copper, lead, magnesium, tin, zinc, antimony, beryllium, bismuth, cadmium, calcium, manganese, selenium, titanium, tungsten and vanadium; and mixtures of them.

The average particle diameter of these magnetic materials is desirably about 0.1 to 2$\mu$. The amount of them in the toner is about 20 to 200 parts by weight, particularly preferably 30 to 150 parts by weight, for 100 parts by weight of the resin.

The toner of the present invention can contain additives, if necessary. The additives are, for example, lubricants such as Teflon and zinc stearate; abrasives such as cerium oxide and silicon carbide; fluidizers such as colloidal silica, titanium oxide and aluminum oxide; caking inhibitors; electric conductivity-imparting agents such as carbon black and tin oxide; and fixing assistants such as low molecular polyethylene and low-molecular polypropylene.

The toner for the development of an electrostatically charged image according to the present invention can be prepared by thoroughly mixing an electric charge regulator of the above general formula (I) with a vinylic or non-vinylic thermoplastic resin, a colorant (dyestuff or pigment) and, if necessary, a magnetic material and additives in a ball mill or another mixer, melt-kneading the mixture by means of a hot kneader such as a heating roll, kneader or extruder to compatibilize the resins, cooling the mixture to solidify it, pulverizing the product and classifying the powders to obtain the toner having an average particle diameter of 8 to 15$\mu$.

Another preparation process comprises dispersing the materials in a solution of the binder resin and spray-drying the dispersion thus obtained. Another process for the preparation of the toner is a polymerization process wherein the binder resin-forming monomer(s) is/are mixed with the given materials to prepare an emulsified suspension, which is then polymerized to prepare the toner.

The toner prepared by the above-mentioned process can be used for the development of an electrostatically charged image by a known method in electrophotography, electrostatic recording and electrostatic printing to exhibit excellent effects as will be described below.

The quantity of the electric charge generated by the frictional electrification of the toner particles is invariable and the quantity of electric charge can be controlled easily. The toner is significantly stable because the quantity of the frictional electric charge is neither dispersed nor reduced by modification during the use. Therefore, troubles such as fog of the image, scattering of the toner and staining of the electrophotographic material or a copying machine can be overcome. Further, the toner of the present invention is quite excellent, since coagulation, solidification to form a mass and fluidization at a low temperature do not occur during the storage and it can be stored for a long period of time. In addition, the toner image has excellent abrasion resistance, fixability and adhesion.

The effects obtained by the present invention are as follows:

(1) An image having a high fidelity to the latent image can be obtained by the development and transfer. Even after the continuous use over a long period of time, the initial characters of the developing agent can be maintained without causing coagulation of the toner or modification of the electrification characters.

(2) With the developing agent of the present invention, a stable image which is not influenced by a change of the temperature or humidity can be reproduced. The image has vivid chromatic colors.

(3) The developing agent of the present invention does not stain, abrade or scar the electrostatic latent image surface and the cleaning can be conducted easily. It has an excellent fixability and poses no problem particularly in high-temperature offset printing.

The above-mentioned excellent effects of the toner become more remarkable when it is used in a repeated transfer-type copying method in which the electrification, exposure, development and transfer are continuously repeated. Further a color image having excellent colors can be formed by using the toner as a color electrophotographic toner, since the color tone is not damaged by the electric charge regulator.

[EXAMPLES]

The following examples will further illustrate the present invention, which by no means limit the invention. In the examples, parts are given by weight.

Example 1

| | |
|---|---|
| styrene/butyl acrylate (30/20) copolymer (weight-average molecular weight $\overline{M}w$: about 300,000) | 100 parts |
| carbon black (Mitsubishi "44) | 10 parts |
| low-molecular polypropylene wax | 2 parts |
| compound (1) | 2 parts |

The above-mentioned materials were thoroughly mixed by means of a blender and then kneaded with a twin-roll kneader heated to 150° C. The kneaded product was left to cool, roughly ground with a cutter mill and then finely ground with a pulverizer with a jet stream. The product was classified with a pneumatic classifier to obtain fine powders having a particle diameter of 5 to 20$\mu$.

5 parts of the fine powders were mixed with 100 parts of a powdery iron carrier having an average particle diameter of 50 to 80μ.

Then an image having a negative electric charge was formed on an OPC photosensitive material by a known electrophotographic method. The image was powder-developed with the developing agent prepared as above by a magnetic brush method to form a toner image. It was transferred onto a paper and fixed by heating. The image thus transferred had a sufficient density and a high resolving power and was free from fog or scattering of the toner around the image. The image was thus excellent. It had a remarkably improved fixing strength. Transfer images were repeatedly produced with the developing agent to examine image durability. After the production of 50,000 copies, the image was by no means inferior to the initial one.

In the durability test, the above-mentioned filming phenomenon of the photosensitive material due to the toner was not observed at all and no problem was posed in the cleaning step. After completion of the durability test in which 50,000 copies were produced, the fixing machine was examined. The roller was neither scarred nor damaged and a stain with the offset toner was scarcely observed. Thus, no practical problem was posed.

The results of the examination of the image conducted under ordinary conditions are summarized in Table 1.

When the environmental conditions were altered to 35° C. and 85%, the obtained image density was almost the same as that obtained at ambient temperature and atmospheric humidity, and the image obtained was clear and free of fog or scattering. As for the durability, the developing agent was scarcely changed during the production of 50,000 copies. Then the same tests as above were conducted except that the temperature and humidity were lowered to 15° C. and 10%, respectively. The image density was sufficient. The solid area was also developed and transferred quite smoothly without causing scattering or failure in transfer in the middle portion to form an excellent image. The durability test was conducted under the above conditions to reveal that the density change was within ±0.2 after the continuous or intermittent copying to produce 50,000 copies. The results were practically sufficient.

Comparative Example 1

A developing agent was prepared in the same manner as in Example 1 except that 2 parts of the compound (1) was replaced with 2 parts of a Nigrosine dye (Nigrosine Base EX;a product of Orient Chemical Industries Co.). After the development, transfer and fixing in the same manner as in Example 1, an image was formed.

The results of the examination of the image conducted under ordinary conditions are shown in Table 1. In the tests conducted at ordinary temperature and ordinary humidity, the image density was as low as 1.00, the line drawing caused scattering and conspicuous roughening was observed in the solid area, though the fog was only slight. The total consumption of the toner in the production of 50,000 copies was larger than that in Example 1 by 20%.

In the durability test, the toner material formed a thin, striped film on the surface of the photosensitive material after the production of about 10,000 copies and, therefore, streaks began to appear on the image. This so-called "filming" phenomenon is caused probably by a charge in the lubricity of the toner powder.

The transfer efficiency which was 80% or higher in the initial step was reduced to 60% after the production of 30,000 copies.

In the durability test, the fixed image was inclined to be rolled up by the fixing roller, the roller surface was stained and the release of the image from the roller was insufficient in the fixing step. In addition, the inside of the apparatus was stained seriously and a problem of the scattering of the toner was posed.

The image formed at 35° C. and 85% humidity had a sufficient density of 1.35 but the scattering and roughening were increased. The transfer efficiency was low and the consumption of the toner was increased.

The image formed at 15° C. and 10% humidity had a density of as low as 0.90 and the scattering, fog and roughening were serious. Local failure in transfer was conspicuous. In the continuous production of the copies, the image density was as low as 0.53 and the image was useless after the production of about 30,000 copies.

Example 2

A developing agent was prepared in the same manner as in Example 1 except that 2 parts of the compound (1) was replaced with 3 parts of the compound (2). After the development, transfer and fixing conducted in the same manner as in Example 1, an image was formed.

The detailed results are shown in Table 1. The results were satisfactory and almost similar to those obtained in Example 1.

Example 3

A developing agent was prepared in the same manner as in Example 1 except that 2 parts of the compound (1) was replaced with 2 parts of the compound (5). After the development, transfer and fixing was conducted in the same manner as above, as image was formed.

The detailed results are shown in Table 1. The results were satisfactory and almost similar to those obtained in Example 1.

Example 4

A developing agent was prepared in the same manner as in Example 1 except that 2 parts of the compound (1) was replaced with 2 parts of the compound (6). After the development, transfer and fixing conducted in the same manner as above, an image was formed.

The detailed results are shown in Table 1. The results were satisfactory and almost similar to those obtained in Example 1.

Example 5

| | |
|---|---|
| styrene/butyl acrylate (80/20) copolymer (weight-average molecular weight $\overline{M}w$: about 300,000) | 100 parts |
| triiron tetroxide EPT-500 (a product of Toda Kogyo Co.) | 60 parts |
| low-molecular polypropylene wax | 2 parts |
| compound (3) | 2 parts |

The above-mentioned materials were thoroughly mixed with a blender and then kneaded with a twin-roll kneader heated to 150° C. The kneaded mixture was left to cool, roughly ground with a cutter mill and then finely ground with a pulverizer with a jet stream. The product was classified with a pneumatic classifier to obtain fine powders having a particle diameter of 5 to 20μ.

The toner thus obtained was used for forming an image on an OPC photosensitive material in a commercially available copying machine in which one-component toner was to be used. Excellent results almost similar to those obtained in Example 1 were obtained as shown in Table 1.

Example 6

A developing agent was prepared in the same manner as in Example 2 except that the styrene/butyl acrylate copolymer was replaced with a polyester resin (polycondensate of polyoxyethylene bisphenol A, polyoxypropylene bisphenol A, terephthalic acid, trimellitic anhydride and tetrapropenylsuccinic anhydride; softening point determined by the ring and ball method: 145° C.). After the development, transfer and fixing conducted in the same manner as in Example 2, an image was formed.

The detailed results are shown in Table 1. The results were satisfactory and almost similar to those obtained in Example 2.

Comparative Example 2

A developing agent was prepared in the same manner as in Example 5 except that 2 parts of the compound (1) used in Example 1 was replaced with 2 parts of benzylmethylhexadecylammonium chloride.

The results of the examination of the image conducted under ordinary conditions are shown in Table 1. In the tests conducted at ambient temperature and ambient humidity, the fog was only slight but the image density was as low as 0.90, the line drawing caused scattering and conspicuous roughening was observed in the solid area. In the durability test, the density was reduced to 0.48 after production of 30,000 copies.

As to the filming phenomenon, problems in the fixing step, transfer efficiency and toner consumption in the durability test, the results were unsatisfactory as in Comparative Example 1.

An image formed under conditions of 35° C. and 85% humidity had an initial image density of as high as 1.35 but it was reduced to 0.72 after the production of 10,000 copies. In addition, fog, scattering and roughening were increased and the image became practically useless. The transfer efficiency was also low. An image formed under conditions of 15° C. and 10% humidity had an image density of as low as 0.70 and the scattering, fog and roughening were serious. Local failure in transfer was conspicuous. In the continuous image formation, the image density was reduced to 0.50 after production of 10,000 copies and the image became practically useless.

Example 7

| | |
|---|---|
| the same polyester resin as in Example 6 | 100 parts |
| Copper Phthalocyanine Blue pigment | 5 parts |
| low-molecular polypropylene wax | 2 parts |
| compound (1) | 2 parts |

The above-mentioned materials were thoroughly mixed with a blender and then kneaded with a twin-roll kneader heated to 150° C. The kneaded mixture was left to cool, roughly ground with a cutter mill and then finely ground with a pulverizer with a jet stream. The product was classified with a pneumatic classifier to obtain fine powders having a particle diameter of 5 to 20μ.

5 parts of the fine powders thus obtained were mixed with 100 parts of a powdery iron carrier having an average particle diameter of 50 to 80μ to obtain a developing agent.

The developing agent thus obtained was used for forming an image in the same manner as in Example 1. The image thus formed was excellent and colored vivid blue. Then, 30,000 copies were produced while the toner was supplemented. The obtained image was excellent.

The results of the examination of the images conducted under ordinary conditions are summarized in Table 1.

Example 8

| | |
|---|---|
| styrene/butyl acrylate (30/20) copolymer (weight-average molecular weight $\overline{M}w$: about 300,000) | 100 parts |
| carbon black (Mitsubishi "44) | 10 parts |
| low-molecular polypropylene wax | 2 parts |
| compound (1) | 4 parts |

The above-mentioned materials were thoroughly mixed by means of a blender and then kneaded with a twin-roll kneader heated to 150° C. The kneaded product was left to cool, roughly ground with a cutter mill and then finely ground with a pulverizer with a jet stream. The product was classified with a pneumatic classifier to obtain fine powders having a particle diameter of 5 to 20μ.

5 parts of the fine powders were mixed with 100 parts of a powdery iron carrier having an average particle diameter of 50 to 80μ.

Then an image having a negative electric charge was formed on an OPC photosensitive material by a known electrophotographic method.

TABLE 1

| Example and Comparative Example No. | Results of examination of image under ordinary conditions: Image density*1 | | Image quality (in the production of 50,000 copies) | | | | | | Fixability*5 and offset printability |
|---|---|---|---|---|---|---|---|---|---|
| | Initial | After production of 50,000 copies | Fog | Scattering of toner | Gradation*2 | Filming | Toner consumption*3 | Transfer*4 efficiency | |
| Example | | | | | | | | | |
| 1 | above 1.3 | above 1.3 | good | good | good | not observed | good | 80% or higher | good |
| 2 | above 1.3 | " | " | " | " | not observed | " | 80% or higher | " |
| 3 | above 1.3 | " | " | " | " | not observed | " | 80% or higher | " |
| 4 | above | " | " | " | " | not ob- | " | 80% or | " |

TABLE 1-continued

| Example and Comparative Example No. | Results of examination of image under ordinary conditions: Image density*1 | | Image quality (in the production of 50,000 copies) | | | | | | Fixability*5 and offset printability |
|---|---|---|---|---|---|---|---|---|---|
| | Initial | After production of 50,000 copies | Fog | Scattering of toner | Gradation*2 | Filming | Toner consumption*3 | Transfer*4 efficiency | |
| 5 | 1.3 above 1.3 | " | " | " | " | served not observed | " | higher 80% or higher | " |
| 6 | 1.3 above 1.3 | " | " | " | " | served not observed | " | 80% or higher | " |
| 7 | 1.3 above 1.3 | " | " | " | " | served not observed | " | 80% or higher | " |
| Comparative Example | | | | | | | | | |
| 1 | 1.0 | 0.80 | occurred | occurred | lowered to gradation 5 | occurred | larger than that in Ex. 1 by 20% | reduced to 60% based on that obtained in Ex. 1 | fixing was insufficient and hot offset occurred |
| 2 | 0.9 | 0.48 (After production of 30,000 copies) | occurred | occurred | lowered to gradation 4 | occurred | larger than that in Ex. 1 by 30% | reduced to 50% based on that obtained in Ex. 1 | fixing was insufficient and hot offset occurred |

(Notes)
*1The image density was determined with an image density meter of Macbeth.
*2The gradation was judged by forming an image of a Kodak gray scale (20 gradations) used as the original and observing the change in the level in the production of 50,000 copies.
*3The toner consumption was determined by using an original having a black to white ratio of 6% and represented in terms of the average consumption in the production of 50,000 copies.
*4In the determination of the transfer efficiency, an original having a black to white ratio of 6% was used, the ratio of the quantity of the recovered toner to the consumption thereof in the production of 50,000 copies was calculated in the production of every 5,000 copies and the change in the ratio was observed.
*5In the determination of the fixability and offset printability, the temperature of the fixing apparatus was controlled and the fixing was conducted at temperature intervals of 10° C. in the range of 150° C. to 240° C.. The results were determined by tape-peeling tests and visual observation.

The image was powder-developed with the developing agent prepared as above by a magnetic brush method to form a toner image. It was transferred onto a paper and fixed by heating. The image thus transferred had a sufficient density and a high resolving power and was free from fog or scattering of the toner around the image. The image was thus excellent. It had a remarkably improved fixing strength. Transfer images were repeatedly produced with the developing agent to examine image durability. After the production of 50,000 copies, the image was by no means inferior to the initial one.

In the durability test, the above-mentioned filming phenomenon of the photosensitive material due to the toner was not observed at all and no problem was posed in the cleaning step. After completion of the durability test in which 50,000 copies were produced, the fixing machine was examined. The roller was neither scarred nor damaged and a stain with the offset toner was scarcely observed. Thus, no practical problem was posed.

The results of the examination of the image conducted under ordinary conditions are summarized in Table 2.

When the environmental conditions were altered to 35° C. and 85 %, the obtained image density was almost the same as that obtained at ambient temperature and atmospheric humidity, and the image obtained was clear and free of fog or scattering. As for the durability, the developing agent was scarcely changed during the production of 50,000 copies. Then the same tests as above were conducted except that the temperature and humidity were lowered to 15° C. and 10 %, respectively. The image density was sufficient. The solid area was also developed and transferred quite smoothly without causing scattering or failure in transfer in the middle portion to form an excellent image. The durability test was conducted under the above conditions to reveal that the density change was within ±0.2 after the continuous or intermittent copying to produce 50,000 copies. The results were practically sufficient.

Example 9

A developing agent was prepared in the same manner as in Example 8 except that 4 parts of the compound (1) was replaced with 5 parts of the compound (2). After the development, transfer and fixing conducted in the same manner as in Example 8, an image was formed.

The detailed results are shown in Table 2. The results were satisfactory and almost similar to those obtained in Example 8.

Example 10

A developing agent was prepared in the same manner as in Example 8 except that 4 parts of the compound (1) was replaced with 4 parts of the compound (5). After the development, transfer and fixing conducted in the same manner as above, an image was formed.

The detailed results are shown in Table 2. The results were satisfactory and almost similar to those obtained in Example 8.

Example 11

A developing agent was prepared in the same manner as in Example 8 except that 4 parts of the compound (1) was replaced with 4 parts of the compound (6). After the development, transfer and fixing conducted in the same manner as above, an image was formed.

The detailed results are shown in Table 2. The results were satisfactory and almost similar to those obtained in Example 8.

Example 12

| | |
|---|---|
| styrene/butyl acrylate (80/20) copolymer (weight-average molecular weight $\overline{M}w$: about 300,000) | 100 parts |
| triiron tetroxide EPT-500 (a product of Toda Kogyo Co.) | 60 parts |
| low-molecular polypropylene wax | 2 parts |

-continued

| | |
|---|---|
| compound (3) | 4 parts |

The above-mentioned materials were thoroughly mixed with a blender and then kneaded with a twin-roll kneader heated to 150° C. The kneaded mixture was left to cool, roughly ground with a cutter mill and then finely ground with a pulverizer with a jet stream. The product was classified with a pneumatic classifier to obtain fine powders having a particle diameter of 5 to 20μ.

The toner thus obtained was used for forming an image on an OPC photosensitive material in a commercially available copying machine in which one-component toner was to be used. Excellent results almost similar to those obtained in Example 8 were obtained as shown in Table 2.

Example 13

A developing agent was prepared in the same manner as in Example 9 except that the styrene/butyl acrylate copolymer was replaced with a polyester resin (polycondensate of polyoxyethylene bisphenol A, polyoxypropylene bisphenol A, terephthalic acid, trimellitic anhydride and tetrapropenylsuccinic anhydride; softening point determined by the ring and ball method: 145° C.). After the development, transfer and fixing conducted in the same manner as in Example 9, an image was formed.

Detailed results are shown in Table 2. They were satisfactory and almost similar to those of Example 9.

Example 14

| | |
|---|---|
| the same polyester resin as in Example 6 | 100 parts |
| Copper Phthalocyanine Blue pigment | 5 parts |
| low-molecular polypropylene wax | 2 parts |
| compound (1) | 4 parts |

The above-mentioned materials were thoroughly mixed with a blender and then kneaded with a twin-roll kneader heated to 150° C. The kneaded mixture was left to cool, roughly ground with a cutter mill and then finely ground with a pulverizer with a jet stream. The product was classified with a pneumatic classifier to obtain fine powders having a particle diameter of 5 to 20μ.

5 parts of the fine powder thus obtained was mixed with 100 parts of a powdery iron carrier having an average particle diameter of 50 to 80μ to obtain a developing agent.

The developing agent thus obtained was used for forming an image in the same manner as in Example 8. The image thus formed was excellent and colored vivid blue. Then, 30,000 copies were produced while the toner was supplemented. The obtained image was excellent.

The results of the examination of the images conducted under ordinary conditions are summarized in Table 2.

Example 15

| | |
|---|---|
| styrene/butyl acrylate (30/20) copolymer (weight-average molecular weight $\overline{M}w$: about 300,000) | 100 parts |
| carbon black (Mitsubishi #44) | 10 parts |
| low-molecular polypropylene wax | 2 parts |
| compound (1) | 2 parts |

The above-mentioned materials were thoroughly mixed by means of a blender and then kneaded with a twin-roll kneader heated to 150° C. The kneaded mixture was left to cool, roughly ground with a cutter mill and then finely ground with a pulverizer with a jet stream.

TABLE 2

| | Results of examination of image conducted under ordinary conditions | | | | | | | | |
|---|---|---|---|---|---|---|---|---|---|
| | Image density*1 | | Image quality (in the production of 50,000 copies) | | | | | | Fixability and offset printability*5 |
| Example | Initial | After production of 50,000 copies | Fog | Scattering of toner | Gradation*2 | Filming | Toner consumption*3 | Transfer efficiency*4 | |
| Example | | | | | | | | | |
| 8 | above 1.3 | above 1.3 | good | good | good | not observed | good | 80% or higher | good |
| 9 | above 1.3 | " | " | " | " | not observed | " | " | " |
| 10 | above 1.3 | " | " | " | " | not observed | " | " | " |
| 11 | above 1.3 | " | " | " | " | not observed | " | " | " |
| 12 | above 1.3 | " | " | " | " | not observed | " | " | " |
| 13 | above 1.3 | " | " | " | " | not observed | " | " | " |
| 14 | above 1.3 | " | " | " | " | not observed | " | " | " |

The product was classified with a pneumatic classifier to obtain fine powders having a particle diameter of 5 to 20μ.

5 parts of the fine powders were mixed with 100 parts of a powdery iron carrier having an average particle diameter of 50 to 80μ.

Then an image having a negative electric charge was formed on an OPC photosensitive material by a known electrophotographic method. The image was powder-developed with the developing agent prepared as above by a magnetic brush method to form a toner image. It was transferred onto a paper and fixed by heating. The image thus transferred had a sufficient density and a high resolving powder and was free from fog or scattering of the toner around the image. The image was thus excellent. It had a remarkably improved fixing strength. Transfer images were repeatedly produced with the developing agent to examine image durability. After the production of 50,000 copies, the image was by no means inferior to the initial one.

In the durability test, the above-mentioned filming phenomenon of the photosensitive material due to the toner was not observed at all and no problem was posed in the cleaning step. After completion of the durability test in which 50,000 copies were produced, the fixing machine was examined. The roller was neither scarred nor damaged and a stain with the offset toner was scarcely observed. Thus, no practical problem was posed.

The results of the examination of the image conducted under ordinary conditions are summarized in Table 3.

When the environmental conditions were altered to 35° C. and 85 %, the obtained image density was almost the same as that obtained at ambient temperature and atmospheric humidity, and the image obtained was clear and free of fog or scattering. As for the durability, the developing agent was scarcely changed during the production of 50,000 copies. Then the same tests as above were conducted except that the temperature and humidity were lowered to 15° C. and 10 %, respectively. The image density was sufficient. The solid area was also developed and transferred quite smoothly without causing scattering or failure in transfer in the middle portion to form an excellent image. The durability test was conducted under the above conditions to reveal that the density change was within ±0.2 after the continuous or intermittent copying to produce 50,000 copies. The results were practically sufficient.

Example 16

A developing agent was prepared in the same manner as in Example 15 except that 2 parts of the compound (1) was replaced with 3 parts of the compound (2). After the development, transfer and fixing conducted in the same manner as in Example 15, an image was formed.

The detailed results are shown in Table 3. The results were satisfactory and almost similar to those obtained in Example 15.

Example 17

A developing agent was prepared in the same manner as in Example 15 except that 2 parts of the compound (1) was replaced with 2 parts of the compound (5). After the development, transfer and fixing conducted in the same manner as above, an image was formed.

The detailed results are shown in Table 3. The results were satisfactory and almost similar to those obtained in Example 15.

Example 18

A developing agent was prepared in the same manner as in Example 15 except that 2 parts of the compound (1) was replaced with 2 parts of the compound (6). After the development, transfer and fixing conducted in the same manner as above, an image was formed.

The detailed results are shown in Table 3. The results were satisfactory and almost similar to those obtained in Example 15.

Example 19

| | |
|---|---|
| styrene/butyl acrylate (80/20) | 100 parts |

-continued

| | |
|---|---|
| copolymer (weight-average molecular weight $\overline{M}w$: about 300,000) | |
| triiron tetroxide EPT-500 (a product of Toda Kogyo Co.) | 60 parts |
| low-molecular polypropylene wax | 2 parts |
| compound (3) | 2 parts |

The above-mentioned materials were thoroughly mixed with a blender and then kneaded with a twin-roll kneader heated to 150° C. The kneaded mixture was left to cool, roughly ground with a cutter mill and then finely ground with a pulverizer with a jet stream. The product was classified with a pneumatic classifier to obtain fine powders having a particle diameter of 5 to 20μ.

The toner thus obtained was used for forming an image on an OPC photosensitive material in a commercially available copying machine in which one-component toner was to be used. Excellent results almost similar to those obtained in Example 15 were obtained as shown in Table 3.

Example 20

A developing agent was prepared in the same manner as in Example 16 except that the styrene/butyl acrylate copolymer was replaced with a polyester resin (polycondensate of polyoxyethylene bisphenol A, polyoxypropylene bisphenol A, terephthalic acid, trimellitic anhydride and tetrapropenylsuccinic anhydride; softening point determined by the ring and ball method: 145° C.). After the development, transfer and fixing conducted in the same manner as in Example 16, an image was formed.

The detailed results are shown in Table 3. They were satisfactory and almost similar to those obtained in Example 16.

Example 21

| | |
|---|---|
| the same polyester resin as in Example 20 | 100 parts |
| Copper Phthalocyanine Blue pigment | 5 parts |
| low-molecular polypropylene wax | 2 parts |
| compound (1) | 2 parts |

The above-mentioned materials were thoroughly mixed with a blender and then kneaded with a twin-roll kneader heated to 150° C. The kneaded mixture was left to cool, roughly ground with a cutter mill and then finely ground with a pulverizer with a jet stream. The product was classified with a pneumatic classifier to obtain fine powders having a particle diameter of 5 to 20μ.

5 parts of the fine powders thus obtained were mixed with 100 parts of a powder iron carrier having an average particle diameter of 50 to 80μ to obtain a developing agent.

The developing agent thus obtained was used for forming an image in the same manner as in Example 15. The image thus formed was excellent and colored vivid blue. Then, 30,000 copies were produced while the toner was supplemented. The obtained image was excellent.

The results of the examination of the images conducted under ordinary conditions are summarized in Table 3.

TABLE 3

| Example | Results of examination of image conducted under ordinary conditions | | | | | |
|---|---|---|---|---|---|---|
| | Image density*1 | | Image quality (in the production of 50,000 copies) | | | |
| | Initial | After production of 50,000 copies | Fog | Scattering of toner | Gradation*2 | Filming |
| Example 15 | above 1.3 | above 1.3 | good | good | good | not observed |
| Example 16 | " | " | " | " | " | " |
| Example 17 | " | " | " | " | " | " |
| Example 18 | " | " | " | " | " | " |
| Example 19 | " | " | " | " | " | " |
| Example 20 | " | " | " | " | " | " |
| Example 21 | " | " | " | " | " | " |

| Example | Results of examination of image conducted under ordinary conditions | | |
|---|---|---|---|
| | Image quality (in the production of 50,000 copies) | | Fixability and offset printability*5 |
| | Toner consumption*3 | Transfer efficiency*4 | |
| Example 15 | good | 80% or higher | good |
| Example 16 | " | " | " |
| Example 17 | " | " | " |
| Example 18 | " | " | " |
| Example 19 | " | " | " |
| Example 20 | " | " | " |
| Example 21 | " | " | " |

What is claimed is:

1. A toner for the development of an electrostatically charged image comprising at least a binder resin, a colorant and a compound of the following formula (I) or (III):

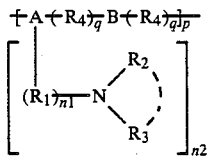

(I)

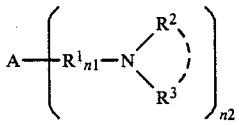

(III)

wherein

A represents a phenol group-containing compound residue,

B represents a group of the general formula (II):

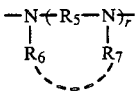

(II)

wherein $R_1$ and $R_4$ each represent a methylene or ethylene group, $R_2$ and $R_3$ each represent an alkyl, aryl, alkenyl, aralkyl or cyclic alkyl group or $R_2$ and $R_3$ may be combined to form a ring, $R_5$ represents an alkylene group having 1 to 8 carbon atoms or an arylene group, preferably phenylene, $R_6$ and $R_7$ each represent a hydrogen atom or an alkyl, aryl, aminoalkyl, aralkyl or cyclic alkyl group having 1 to 8 carbon atoms or $R_6$ and $R_7$ may be combined to form a ring, p represents a number of 1 to 200, $n_1$ and q each is zero or 1, r is zero or an integer of 1 to 3 and $n_2$ is an integer of 1 to 3 or zero in the formula (I) and 1 to 400 in the formula (III).

2. The toner for development of an electrostatically charged image according to claim 1 wherein the amount of the compound of the general formula (I) or (III) is 0.01 to 10 parts by weight for 100 parts by weight of the binder resin.

3. The toner for development of an electrostatically charged image according to claim 1 wherein the compound represented by the general formula (I) or (III) has a softening point of at least 50° C.

* * * * *